US006374419B1

(12) United States Patent
Pietsch

(10) Patent No.: US 6,374,419 B1
(45) Date of Patent: Apr. 23, 2002

(54) NOVELTY HAT

(76) Inventor: Jeffrey D. Pietsch, 3009 Junie La., Taylor, TX (US) 76574

( * ) Notice: Subject to any disclaimer, the term of this patent is extended or adjusted under 35 U.S.C. 154(b) by 0 days.

(21) Appl. No.: 09/775,439

(22) Filed: Feb. 2, 2001

(51) Int. Cl.[7] ..... A42B 1/24
(52) U.S. Cl. ..... 2/209.13; 446/27
(58) Field of Search ..... 2/209.13, 175.1, 2/195.1, 425; 446/27

(56) References Cited

U.S. PATENT DOCUMENTS

| | | | | | |
|---|---|---|---|---|---|
| 1,551,454 | A | * | 8/1925 | Bacon | 2/209.13 |
| 1,727,484 | A | * | 9/1929 | Myers | 2/209.13 |
| 1,776,175 | A | * | 9/1930 | Wittekind | 2/209.13 |
| 2,497,527 | A | * | 2/1950 | Bacon | 2/209.13 |
| 4,776,043 | A | | 10/1988 | Coleman | |
| 4,991,235 | A | * | 2/1991 | Warner | 2/171.1 |
| D368,354 | S | | 4/1996 | Edwards, Jr. | |
| D393,536 | S | | 4/1998 | Buffer et al. | |
| 5,768,714 | A | * | 6/1998 | Bowhey | 2/410 |
| D406,437 | S | | 3/1999 | Tulleners | |
| D407,536 | S | | 4/1999 | Segal | |
| 6,000,063 | A | * | 12/1999 | Sullivan | 2/209.13 |
| 6,012,174 | A | * | 1/2000 | Rech et al. | 2/200.1 |

* cited by examiner

*Primary Examiner*—John J. Calvert
*Assistant Examiner*—Katherine Moran

(57) ABSTRACT

A novelty hat for providing headwear that may be decorated to resemble racing vehicles. The novelty hat includes a decorative hat shell resembling a vehicle. The shell is formed of a plastic and has a top wall, a front wall, a rear wall, a first lateral side wall, a second lateral side wall such that an interior of the shell is defined. The shell has an open bottom side for access into the interior of the shell. A head engaging member is positioned in the interior of the shell and is attached to the first and second lateral side walls.

11 Claims, 3 Drawing Sheets

NOVELTY HAT

BACKGROUND OF THE INVENTION

1. Field of the Invention

The present invention relates to hats and more particularly pertains to a new novelty hat for providing headwear that may be decorated to resemble racing vehicles.

2. Description of the Prior Art

The use of hats is known in the prior art. More specifically, hats heretofore devised and utilized are known to consist basically of familiar, expected and obvious structaral configurations, notwithstanding the myriad of designs encompassed by the crowded prior art which have been developed for the fulfillment of countless objectives and requirements.

Known prior art includes U.S. Des. Pat. No. 406,437; U.S. Des. Pat. No. 393,536; U.S. Des. Pat. No. 407,536; U.S. Pat. No. 4,991,235; U.S. Pat. No. 4,776,043; and U.S. Des. Pat. No. 368,354.

While these devices fulfill their respective, particular objectives and requirements, the aforementioned patents do not disclose a new novelty hat. The inventive device includes a decorative hat shell resembling a vehicle. The shell is formed of a plastic and has a top wall, a front wall, a rear wall, a first lateral side wall, a second lateral side wall such that an interior of the shell is defined. The shell has an open bottom side for access into the interior of the shell. A head engaging member is positioned in the interior of the shell and is attached to the first and second lateral side walls.

In these respects, the novelty hat according to the present invention substantially departs from the conventional concepts and designs of the prior art, and in so doing provides an apparatus primarily developed for the purpose of providing headwear that may be decorated to resemble racing vehicles.

SUMMARY OF THE INVENTION

In view of the foregoing disadvantages inherent in the known types of hats now present in the prior art, the present invention provides a new novelty hat construction wherein the same can be utilized for providing headwear that may be decorated to resemble racing vehicles.

The general purpose of the present invention, which will be described subsequently in greater detail, is to provide a new novelty hat apparatus and method which has many of the advantages of the hats mentioned heretofore and many novel features that result in a new novelty hat which is not anticipated, rendered obvious, suggested, or even implied by any of the prior art hats, either alone or in any combination thereof.

To attain this, the present invention generally comprises a decorative hat shell resembling a vehicle. The shell is formed of a plastic and has a top wall, a front wall, a rear wall, a first lateral side wall, a second lateral side wall such that an interior of the shell is defined. The shell has an open bottom side for access into the interior of the shell. A head engaging member is positioned in the interior of the shell and is attached to the first and second lateral side walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new novelty hat apparatus and method which has many of the advantages of the hats mentioned heretofore and many novel features that result in a new novelty hat which is not anticipated, rendered obvious, suggested, or even implied by any of the prior art hats, either alone or in any combination thereof.

It is another object of the present invention to provide a new novelty hat which may be easily and efficiently manufactured and marketed.

It is a further object of the present invention to provide a new novelty hat which is of a durable and reliable construction.

An even further object of the present invention is to provide a new novelty hat which is susceptible of a low cost of manufacture with regard to both materials and labor, and which accordingly is then susceptible of low prices of sale to the consuming public, thereby making such novelty hat economically available to the buying public.

Still yet another object of the present invention is to provide a new novelty hat which provides in the apparatuses and methods of the prior art some of the advantages thereof, while simultaneously overcoming some of the disadvantages normally associated therewith.

Still another object of the present invention is to provide a new novelty hat for providing headwear that may be decorated to resemble racing vehicles.

Yet another object of the present invention is to provide a new novelty hat which includes a decorative hat shell resembling a vehicle. The shell is formed of a plastic and has a top wall, a front wall, a rear wall, a first lateral side wall, a second lateral side wall such that an interior of the shell is defined. The shell has an open bottom side for access into the interior of the shell. A head engaging member is positioned in the interior of the shell and is attached to the first and second lateral side walls.

Still yet another object of the present invention is to provide a new novelty hat that has an adjustable head engaging member for fitting variously sized heads.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
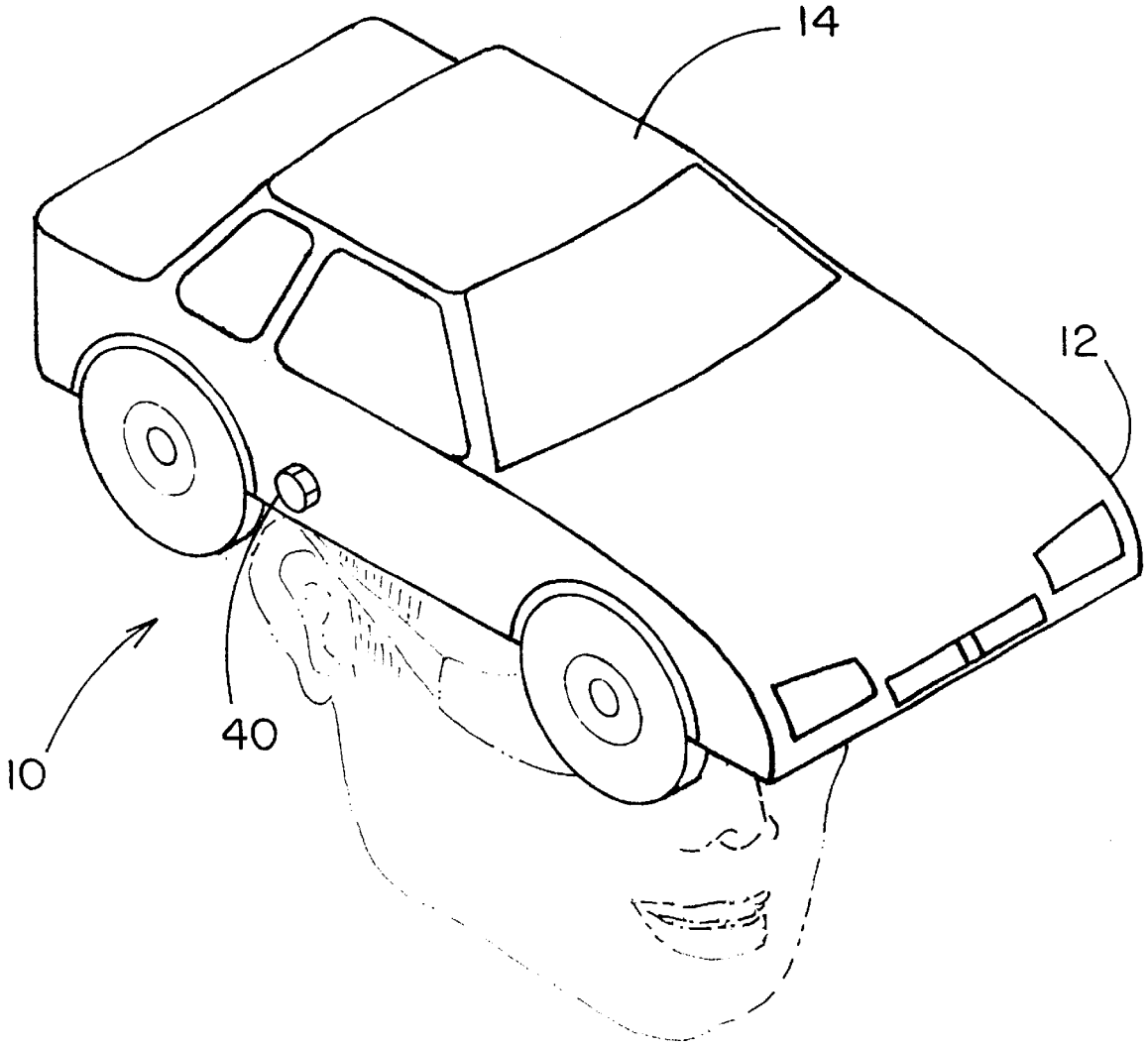
FIG. 1 is a schematic perspective view of a new novelty hat according to the present invention.
Figure 2:
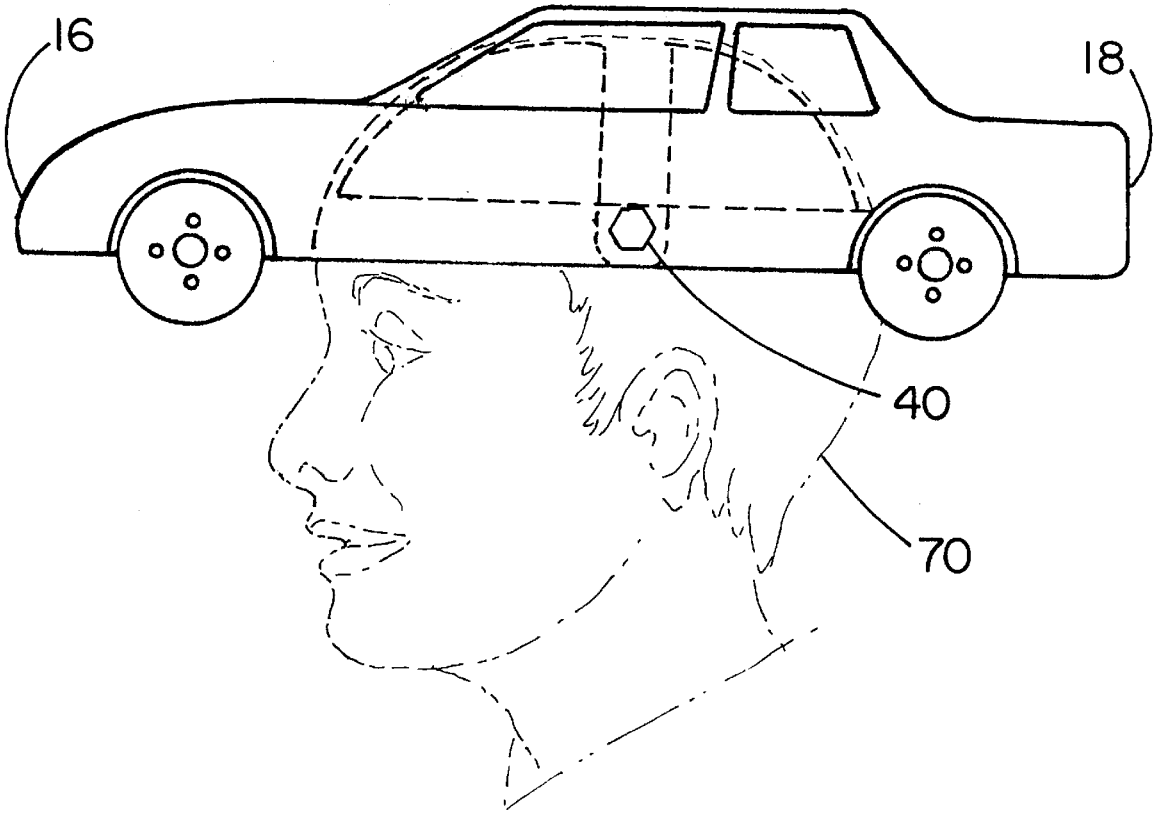
FIG. 2 is a schematic side view of the present invention.
Figure 3:
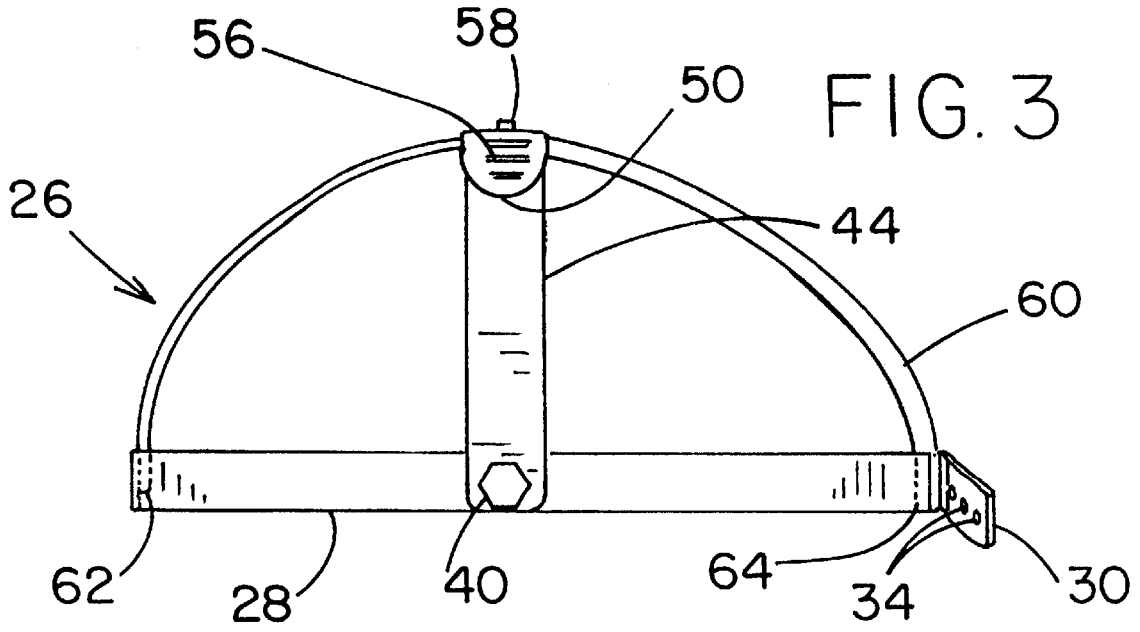
FIG. 3 is a schematic side view of the head engaging member of the present invention.
Figure 4:
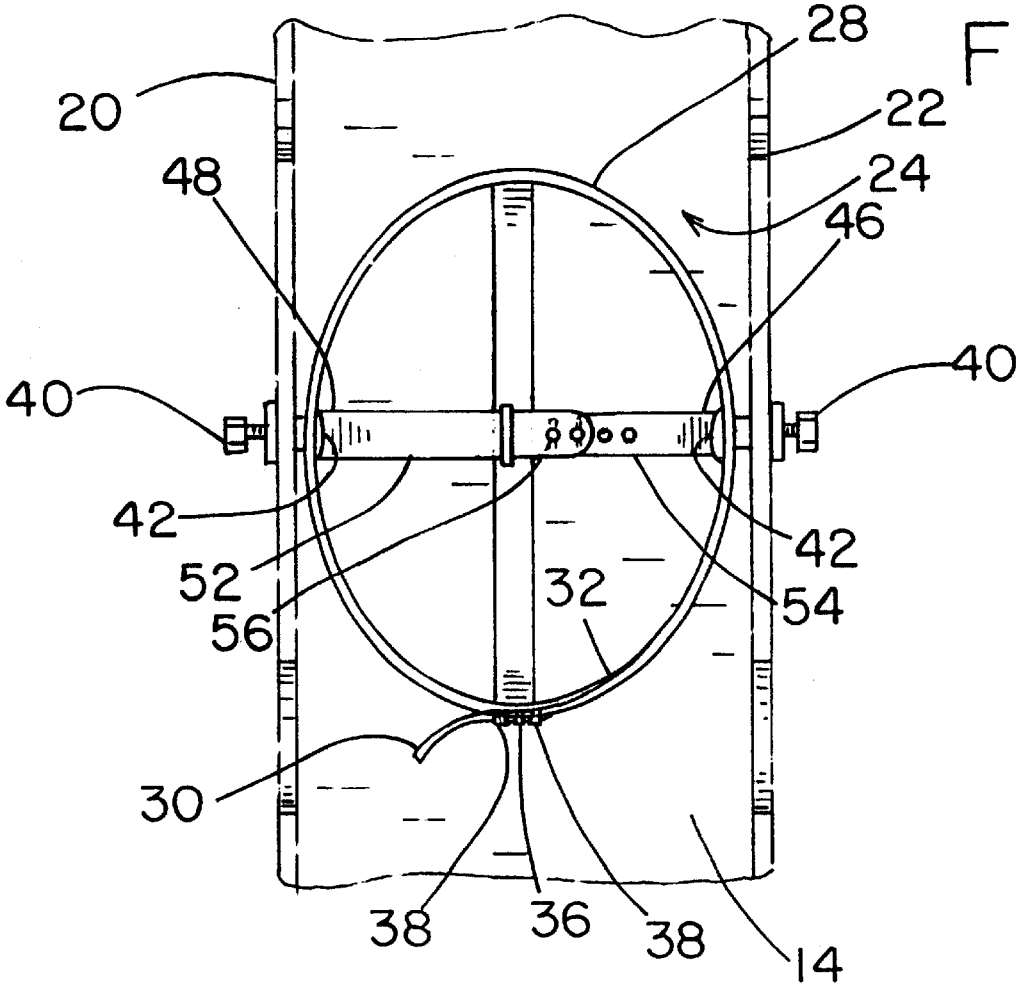
FIG. 4 is a schematic bottom view of the present invention.

With reference now to the drawings, and in particular to FIGS. 1 through 4 thereof, a new novelty hat embodying the principles and concepts of the present invention and generally designated by the reference numeral 10 will be described.

As best illustrated in FIGS. 1 through 4, the novelty hat 10 generally comprises a decorative hat shell 12 resembling a vehicle. The vehicle is preferably a stock car or other racing vehicle. The shell 12 is formed of a plastic and has a top wall 14, a front wall 16, a rear wall 18, a first lateral side wall 20, and a second lateral side wall 22 such that an interior of the shell is defined. The shell 12 may be made of styrofoam for lightness of weight. The shell 12 has an open bottom side 24 for access into the interior of the shell 12. The shell 12 has a length preferably between 16 inches and 20 inches, a height between 5 inches and 7 inches and a width between 7 inches and 9 inches.

A head engaging member 26 is positioned in the interior of the shell 12 and is attached to the first 20 and second 22 lateral side walls. The head engaging member 26 includes a first strap 28 having a first end 30 and a second end 32. The first strap 28 has a plurality of aligned holes 34 therein positioned generally adjacent to the first end of the first strap 28. A nub 36 is attached to the first strap 28 and is positioned generally adjacent to the second end 32 of the first strap 28. A pair of loop members 38 is attached to the first strap 28 and is positioned on either side of the nub 36. The first end 30 of the first strap 28 may be extended through the loop members 38 such that the nub 36 may engage one of the holes 34.

A pair of securing members 40 each threadably engages and extends through one of the first 20 and second 22 lateral side walls. Each of the securing members 40 is positioned generally adjacent to the bottom side 24. Each of the securing members 40 has a first end 42 positioned in the shell and rotatably coupled to the first strap 28 such that the first strap 28 defines a generally annular member. The first ends 42 of the securing members 40 are selectively positioned between positions adjacent to an associated one of the lateral side walls 20, 22 and a position inward of the shell 12. By moving the securing members 40 inward, they may secure the shell to the head 70 of a wearer of the shell 12.

A second strap 44 has a first end 46 and a second end 48 each coupled to the first strap 28. The second strap 44 has a break 50 therein such that the first section 52 and a second section 54 of the second strap 44 are defined. The first section 52 has a plurality of aligned holes 56 therein. The second section 54 has a nub 58 attached thereto located generally adjacent to the break 50. The nub 58 on the second section is removably positioned in one of the holes 56 in the first section.

A third strap 60 has a first end 62 and a second end 64 each attached to the first strap 28 and traversing the second strap 44. The third strap 60 may have a break therein and a nub and hole coupling system similar to the second strap 44.

In use, the device is worn as a conventional hat. The outer surface of the shell may be decorated to with decals and paint to resemble stock cars and other racing vehicles.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A novelty hat comprising:

a decorative hat shell resembling a vehicle, said shell being formed of a plastic and having a top wall, a front wall, a rear wall, a first lateral side wall, a second lateral side wall such that an interior of said shell is defined, said shell having an open bottom side for access into said interior of said shell;

a head engaging member being positioned in said interior of said shell and being attached to said first and second lateral side walls, said head engaging member including a strap having first end and a second end, said strap having a plurality of aligned holes therein positioned generally adjacent to said first end of said strap, a nub being attached to said first strap and being positioned generally adjacent to said second end of said first strap, wherein said nub may engage one of said holes; and a pair of securing members each threadably engaged to and extending through one of said first and second lateral side walls, each of said securing members being positioned generally adjacent to said bottom side, each of said securing members having a first end positioned in said shell and being coupled to said first strap such that said first strap defines a generally annular member, each of said first ends of said securing members being selectively positioned between positions adjacent to an associated one of said lateral side walls and a position inward of said shell.

2. The novelty hat device as in claim 1, said shell has a length generally between 16 inches and 20 inches, a height generally between 5 inches and 7 inches and a width generally between 7 inches and 9 inches.

3. The novelty hat device as in claim 1, wherein said strap defines a first strap, said head engaging member further including a second strap having a first end and a second end each coupled to said first strap.

4. The novelty hat device as in claim 3, wherein said second strap has a break therein such that first section and a second section of said second strap are defined, said first section having a plurality of aligned holes therein, said second section having a nub attached thereto located generally adjacent to said break, said nub on said second section being removably positioned in one of said holes in said first section.

5. The novelty hat device as in claim 4, further including a third strap having a first end and a second end each attached to said first strap and traversing said second strap.

6. A novelty hat comprising:

a decorative hat shell resembling a vehicle, said shell being formed of a plastic and having a top wall, a front wall, a rear wall, a first lateral side wall, a second lateral side wall such that an interior of said shell is defined, said shell having an open bottom side for access into said interior of said shell, said shell having a length generally between 16 inches and 20 inches, a height generally between 5 inches and 7 inches and a width generally between 7 inches and 9 inches;

a head engaging member being positioned in said interior of said shell and being attached to said first and second lateral side walls, said head engaging member including:

a first strap having first end and a second end, said first strap having a plurality of aligned holes therein positioned generally adjacent to said first end of said first strap, a nub being attached to said first strap and being positioned generally adjacent to said second end of said first strap, a pair of loop members being attached to said first strap and being positioned on either side of said nub, wherein said first end of said first strap may be extended through said loop members such that said nub may engage one of said holes;

a pair of securing members each threadably engaged to and extending through one of said first and second lateral side walls, each of said securing members being positioned generally adjacent to said bottom side, each of said securing members having a first end positioned in said shell and being coupled to said first strap such that said first strap defines a generally annular member, each of said first ends of said securing members being selectively positioned between positions adjacent to an associated one of said lateral side walls and a position inward of said shell;

a second strap having first end and a second end each coupled to said first strap, said second strap having a break therein such that first section and a second section of said section strap are defined, said first section having a plurality of aligned holes therein, said second section having a nub attached thereto located generally adjacent to said break, said nub on said second section being removably positioned in one of said holes in said first section; and a third strap having a first end and a second end each attached to said first strap and traversing said second strap.

7. A novelty hat comprising:

a decorative hat shell resembling a vehicle and having a top wall, a front wall, a rear wall, a first lateral side wall, a second lateral side wall such that an interior of said shell is defined, said shell having an open bottom side for access into said interior of said shell;

a head engaging member being positioned in said interior of said shell and being attached to said first and second lateral side walls; and a pair of securing members each threadably engaged to and extending through one of said first and second lateral side walls, each of said securing members being positioned generally adjacent to said bottom side, each of said securing members having a first end positioned in said shell, each of said first ends of said securing members being selectively positioned between positions adjacent to an associated one of said lateral side walls and a position inward of said shell.

8. The novelty hat device as in claim 7, said head engaging member includes a first strap having first end and a second end, said first strap having a plurality of aligned holes therein positioned generally adjacent to said first end of said first strap, a nub being attached to said first strap and being positioned generally adjacent to said second end of said first strap, wherein said nub may engage one of said holes.

9. The novelty hat device as in claim 8, further including a second strap having a first end and a second end each coupled to said first strap.

10. The novelty hat device as in claim 9, further including a third strap having a first end and a second end each attached to said first strap and traversing said second strap.

11. The novelty hat device as in claim 9, wherein said second strap has a break therein such that first section and a second section of said second strap are defined, said first section having a plurality of aligned holes therein, said second section having a nub attached thereto located generally adjacent to said break, said nub on said second section being removably positioned in one of said holes in said first section.

* * * * *